US006431085B1

(12) United States Patent
Saxton et al.

(10) Patent No.: US 6,431,085 B1
(45) Date of Patent: Aug. 13, 2002

(54) CENTER BEAM CAR WITH DEPRESSED CARGO-CARRYING AREA

(75) Inventors: Gregory J. Saxton, Gresham; John N. Niosi, Portland; Michael D. Hubbard, Portland; Daniel V. Militaru, Portland; Kris M. Heitmeyer, West Linn, all of OR (US)

(73) Assignee: Gunderson, Inc., Portland, OR (US)

( * ) Notice: Subject to any disclaimer, the term of this patent is extended or adjusted under 35 U.S.C. 154(b) by 0 days.

(21) Appl. No.: 09/747,758

(22) Filed: Dec. 20, 2000

(51) Int. Cl.[7] ..... B61D 17/00

(52) U.S. Cl. ..... 105/355; 105/404; 105/416; 105/422

(58) Field of Search ..... 105/355, 404, 105/409, 410, 413, 414, 420, 416, 422; 410/139, 37, 38

(56) References Cited

U.S. PATENT DOCUMENTS

| | | | | |
|---|---|---|---|---|
| 2,996,020 A | | 8/1961 | Udstad | 105/367 |
| 3,713,400 A | | 1/1973 | Teoli | 105/406 R |
| 3,734,031 A | | 5/1973 | Wagner | 105/367 |
| 3,774,554 A | * | 11/1973 | O'Neill et al. | 105/413 |
| 3,814,028 A | * | 6/1974 | Adler | 105/422 |
| 3,964,399 A | * | 6/1976 | Miller et al. | 105/406.1 |
| 4,024,821 A | | 5/1977 | Yang | 105/406 R |
| 4,079,676 A | | 3/1978 | Miller | 105/411 |
| RE30,388 E | | 9/1980 | Mundinger et al. | 410/139 |
| 4,236,459 A | | 12/1980 | Teoli | 105/406 R |
| 4,331,083 A | | 5/1982 | Landregan et al. | 105/406 R |
| 4,543,887 A | * | 10/1985 | Baker | 105/355 |
| 4,626,017 A | | 12/1986 | Robertson | 296/3 |
| 4,690,072 A | | 9/1987 | Wile et al. | 105/406.1 |
| 4,753,175 A | | 6/1988 | Harris et al. | 105/355 |
| 4,784,067 A | | 11/1988 | Harris | 105/355 |
| 4,802,420 A | | 2/1989 | Butcher | 105/355 |
| 4,951,575 A | * | 8/1990 | Dominguez et al. | 105/406.1 |
| 5,088,417 A | | 2/1992 | Richmond | 105/411 |
| 5,582,495 A | | 12/1996 | Schroeder | 410/32 |
| 5,626,083 A | | 5/1997 | Saxton | 105/355 |
| 6,199,486 B1 | | 3/2001 | Landrum et al. | 105/396 |

OTHER PUBLICATIONS

Thrall Car Mfg. Prototype car with reduced height center partition, at least as early as Sep. 2000.
BNSF "FleXibeam" center partition car No. 564,124, at least as early as Jun. 2000.

* cited by examiner

*Primary Examiner*—S. Joseph Morano
*Assistant Examiner*—Frantz F. Jules
(74) *Attorney, Agent, or Firm*—Chernoff, Vilhauer, McClung & Stenzel, LLP

(57) ABSTRACT

A center partition or center beam railroad freight car with a bulkhead at each end and a depressed cargo-carrying floor located on each side of the center beam in an intermediate portion of the car located between respective end portions of the car having higher floors. A wide bottom plate of the center sill in the intermediate portion of the car is included as a part of the depressed cargo-carrying floor, and cross-bearers are attached to the bottom of the center sill, extending laterally to side sills in the intermediate section of the car to support floor sheets that extend laterally outward from the bottom plate of the center sill. Longitudinal stringers are attached to the underside of the bottom plate of the center sill between the crossbearers. A body bolster has arms that extend diagonally upward and outward to side sills supporting the higher floors in the end portions of the car.

22 Claims, 8 Drawing Sheets

CENTER BEAM CAR WITH DEPRESSED CARGO-CARRYING AREA

BACKGROUND OF THE INVENTION

The present invention relates to freight-carrying railroad cars of the type known as center beam or center partition bulkhead flat cars, and in particular relates to such a car having a load-carrying floor located at a depressed height in a longitudinally intermediate portion of its body.

Center partition bulkhead flat cars, commonly known as center beam cars, have been known for over 30 years and are depicted, for example, in Taylor U.S. Pat. No. 3,244,120, Wagner U.S. Pat. No. 3,734,031, Baker U.S. Pat. No. 4,543,887, and Saxton U.S. Pat. No. 5,758,584. Evolving design of such railroad cars has been directed generally toward cars with ample strength but of lighter tare weight in comparison.to their cargo-carrying capacity. Construction of center beam cars of lighter weight with load-carrying floors.located at a uniform height along the length of the car body leaves their load capacity limited by the available space.

Dominguez, et al., U.S. Pat. No. 4,951,575 discloses a center beam car in which a longitudinally intermediate portion of the load-carrying floor on either side of the center beam is located at a lower height than the load-carrying floors located in end portions of the car above the trucks on which the car body is carried. In the intermediate portion of such a car, crossbearers extend between lowered portions of the side sills of the car body and are supported beneath the center sill.

The car disclosed by Dominguez, however, has a conventional box-beam center sill structure, and the crossbearers of the car are attached to the center sill by hanger plates attached to the opposite sides of the center sill and extending downward to support an upper flange portion of each of the crossbearers. The structure of the car shown in the Dominguez et al. patent is thus unnecessarily heavy, making such cars expensive to build and operate.

In most previously available center beam cars the center of gravity has been relatively high because the entire load has been carried above the height of the trucks, but also, at least partly as a result of the height of the center partition extending as high as the bulkheads on the ends of the car.

What is desired, then, is a center beam or center partition bulkhead flat car defining greater useable cargo-carrying volume and having ample strength yet having lighter tare weight than previously available cars of the type, and in particular including improved center sill and crossbearer structures.

SUMMARY OF THE INVENTION

The present invention responds to the aforementioned needs by providing a modified center partition bulkhead flatcar including a center sill extending longitudinally along the car's body, a center beam extending along the center sill with a top chord of the center beam spaced upwardly above the center sill and connected to it by upright members, and including crossbearers each attached to and extending transversely beneath the center sill and supporting a floor on each side of the car body, and wherein in an intermediate portion of the center sill located between the opposite ends of the car body, a bottom plate of the center sill extends laterally outward beyond the side plates of the center sill and acts as an inboard portion of the floor structure.

In one embodiment of this aspect of the invention the crossbearers are of inverted "T" construction including an upright web and a horizontal bottom flange, with a central portion of the flange, located beneath the center sill of the car, being thicker than outboard portions of the bottom flange.

In one embodiment of this aspect of the invention a stringer extends longitudinally along the underside of the bottom plate of the center sill.

A railroad car according to another aspect of the present invention includes an integrated center sill and floor structure in a portion of the body of the car in which the center sill includes a pair of center sill side plates spaced a first distance apart from each other laterally, a center sill bottom plate extending along the bottom margins of the side plates and extending laterally outward beyond each of the side plates, a plurality of crossbearers interconnected with the center sill beneath the bottom plate, a floor sheet mounted atop the crossbearers and extending laterally outward from the bottom plate, and a stringer attached to the underside of the bottom plate at a location outboard from the pair of side plates of the center sill and extending longitudinally from one of the crossbearers to another, forming an integrated structure including the center sill and floor structure.

In one preferred embodiment of this aspect of the invention the crossbearers each include an upstanding web and a horizontal bottom flange forming an inverted T configuration and each crossbearer has opposite ends attached to side sills of the car.

In another preferred embodiment of this aspect of the invention a semi-cylindrical gusset interconnects the bottom plate of the center sill and the web of each crossbearer.

As another aspect of the invention a body bolster in a railroad car according to the present invention includes a pair of arms each extending laterally outward and diagonally upward from the center sill in an end portion of the car to a respective side sill, and a floor support riser is attached to an upper face of each arm of the body bolster and provides support for a floor sheet extending laterally inward from the side sill toward the center beam in the end portion of the car.

In a preferred embodiment of this aspect of the invention longitudinal floor support stringers are carried on a horizontal top face of the floor support riser.

A railroad freight car according to the present invention thus provides capacity for increased cargo volume and has adequate strength in a structure whose tare weight is less than that of previously available railroad freight cars of this general type.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
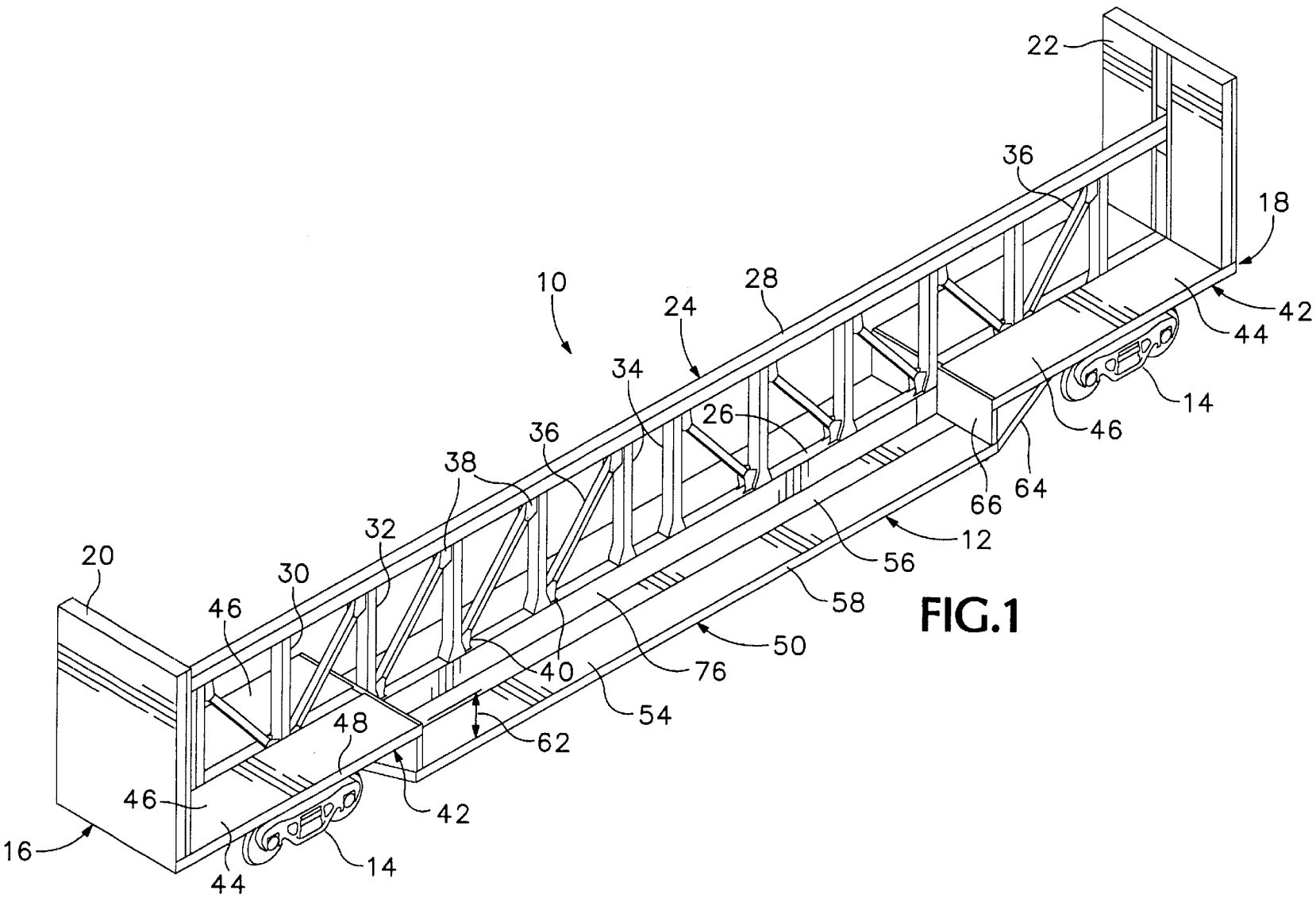
FIG. 1 is an isometric view of a center beam railroad freight car embodying the present invention and including a car body in which a longitudinally intermediate portion includes cargo-carrying floors located at a lower height than cargo-carrying floors in the respective end portions of the car body.

Referring to the drawings which form a part of the disclosure herein, as may be seen in FIG. 1, a center beam car 10 embodying the present invention has a car body 12 of welded steel construction carried on a pair of wheeled trucks 14 located at respective opposite ends 16 and 18 of the car body 12.

Bulkheads 20, 22 are located at the opposite ends 16 and 18, and a center beam 24 extends longitudinally of the car body 12 between the bulkheads 20 and 22.

Figure 2:
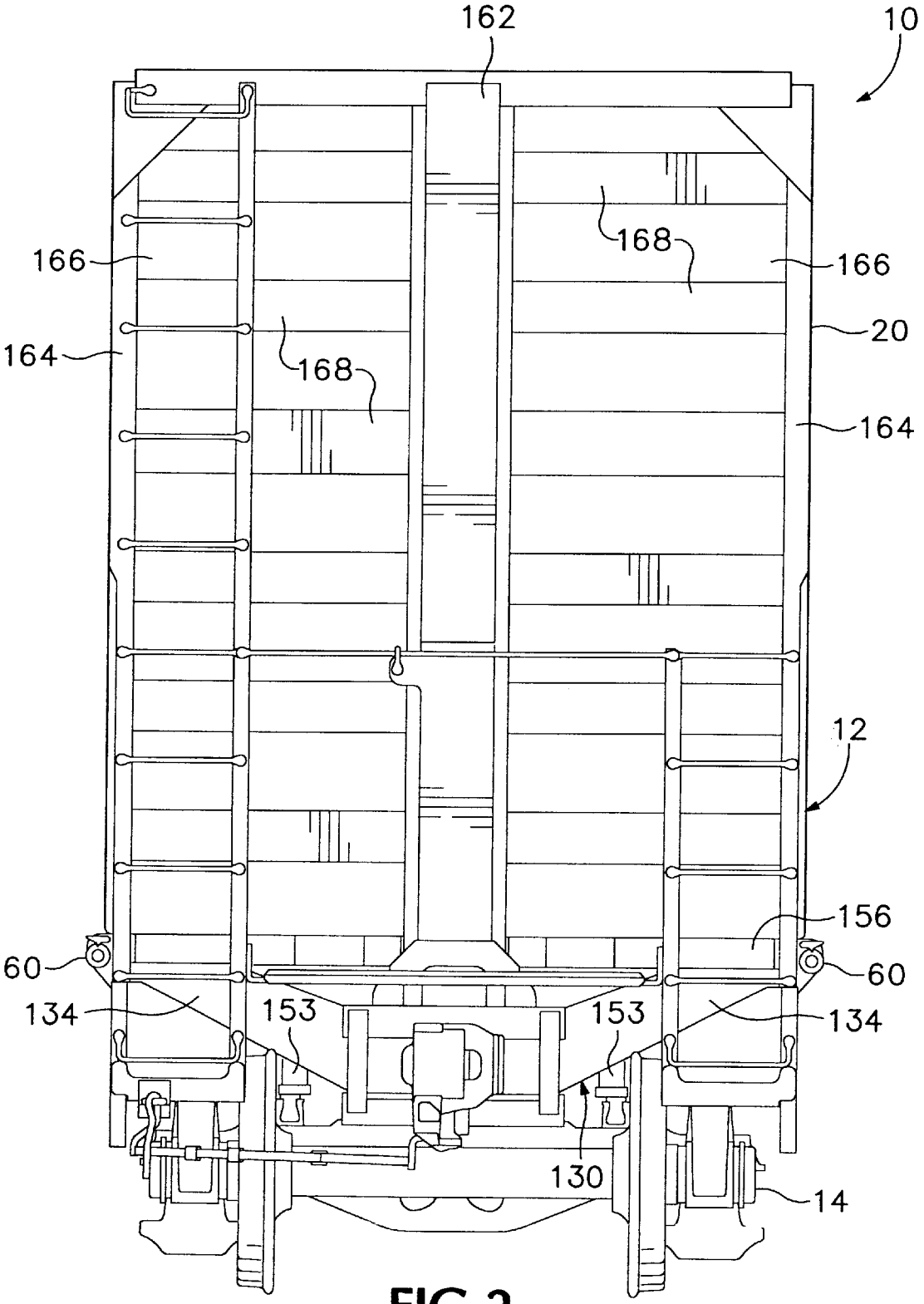
FIG. 2 is an end elevational view of the center beam railroad car shown in FIG. 1.
Figure 3:
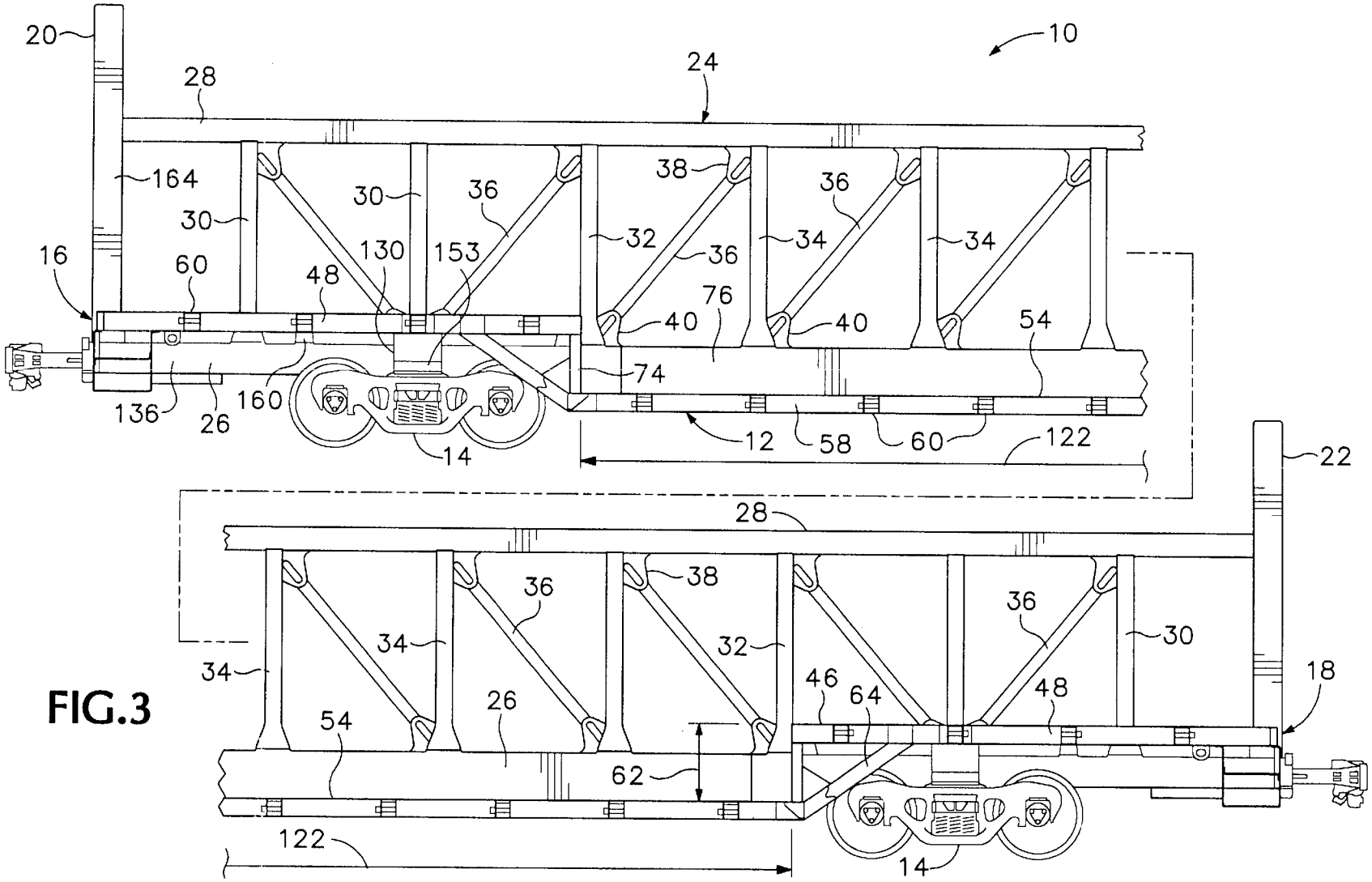
FIG. 3 is a side elevational view of the center beam railroad car shown in FIGS. 1 and 2.

Referring also to FIGS. 2 and 3, the car body 12 includes a center sill 26 that extends from the first end 16 to the other end 18. The center sill 26 acts as part of the bottom chord or flange of the center beam 24. A top chord 28 of the center beam extends longitudinally along the car body 12 a distance above and parallel with the center sill 26 from the bulkhead 20 to the bulkhead 22, and is attached structurally to each of the bulkheads 20 and 22. Vertical columns 30, 32 and 34 in the form of fabricated I-beams extend upward from the center sill 26 to the top chord 28 as the web of the center beam 24. The top chord 28 may, for example, be of 10"×10" square tubing of ½-inch wall thickness. The lower ends of the columns 30, 32, and 34 are flared outward to be broader than the upper portions of the columns, and to match the width of the center sill 26 at the location where each is attached to the center sill 26. The upper portions of the columns are, for example, 10 inches square of welded steel plate.

Square tubular diagonal members 36 are somewhat smaller than the columns 30, 32, and 34 and are attached to respective ones of the columns and to the center sill 26 and top chord 28 by upper end gusset plates 38 and lower end gusset plates 40 welded into place on each side of each diagonal member 36.

Each of a pair of end portions 42 of the car body 12 includes the respective bulkhead 20 or 22 and extending beyond the respective truck 14. A generally horizontal upper level cargo floor 44 is located alongside the respective columns 30 on each lateral side of the center beam 24 in each end portion 42. The floor 44 in each end portion 42 includes a floor sheet 46 on each of the laterally opposite sides of the center beam 24. Each floor sheet 46 extends along and is attached to a respective end portion side sill 48, as will be explained more fully below.

An intermediate portion 50 of the car is located between the two end portions 42. The intermediate portion 50 includes a depressed cargo-carrying floor located on each lateral side of the center beam 24 at a significantly lower height than that of the upper level cargo floors 44 in each of the end portions 42. Whereas the floor sheets 46 are located at a height above the top of the center sill 26, floor sheets 54 of the depressed floor extend in substantially coplanar alignment with a bottom plate 56 of the center sill 26, as is shown most clearly in FIG. 6.

Figure 6:
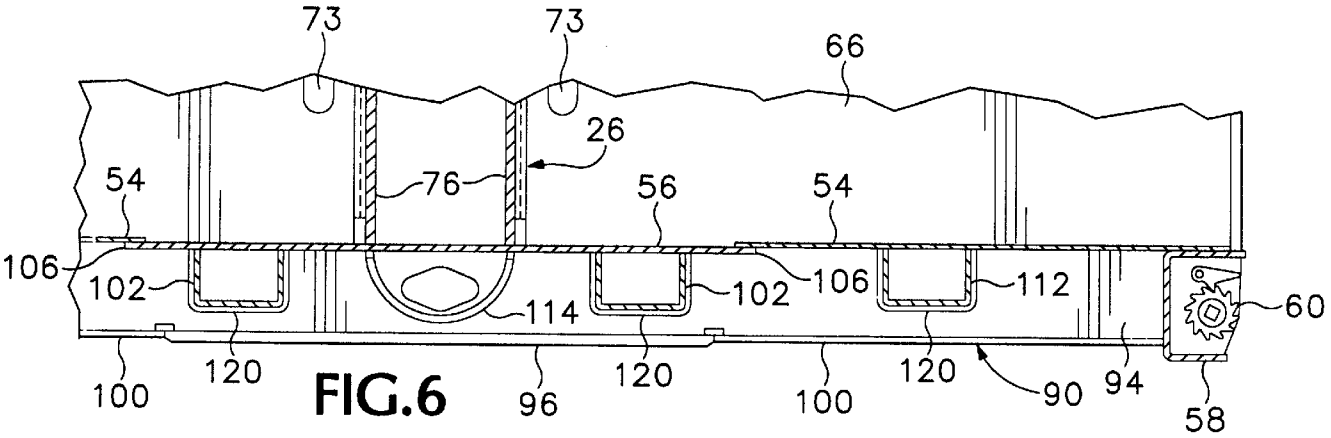
FIG. 6 is a sectional view of a portion of the railroad car shown in FIG. 4, taken along line 6—6.

An outboard margin of each floor sheet 54 is attached to and supported by a respective intermediate portion side sill 58, which may be a channel with unequal flanges of bent plate construction, as is seen best in FIG. 6. Preferably, the side sill 58 channel is formed of 5⁄16 inch steel plate, and has its flanges facing outboard to provide a protected location for cargo tie-down strap spools 60 in the intermediate portion 50 of the car body 12.

A height difference 62 between the floors 44 and the floor sheets 54, shown in FIGS. 1 and 3, is preferably equal to or a multiple of the usual height of a package of goods, for example a bundle of plywood, intended to be carried on the center beam car 10. For example, the height difference 62 may preferably be about 33 inches, equal to the height of a bundle of plywood including its packaging and leaving room for stickers providing clearance beneath the plywood for the forks of a forklift truck or other cargo-handling equipment.

A floor support transition portion of the car body 12 includes diagonal structural members 64, which may be channels, and a shear plate 66 located on each side of the center sill 26 and supported by stiffening channel structures 68, 70 and 72. Reinforcing angles 73 seen in FIGS. 6 and 8 assist in reinforcing the shear plates 66 and connecting the shear plates 66 with the side plates 76 of the center sill 26. Transitional side posts 74 on each side of the car body interconnect the upper, or end portion side sills 48 with the intermediate portion side sill 58.

Referring now to FIGS. 4, 5, 6 and 7, in the intermediate portion 50 of the car body 12, the center sill 26 is integrated with the structure of the floors on either side of the center sill. As shown best in FIG. 6, the center sill 26 in the intermediate portion 50 of the car includes a pair of parallel upright side plates 76 having a thickness 78 of, preferably, 5⁄16 inch plate, extending longitudinally and spaced apart laterally by a distance 80 of, for example, 9-3⁄8 inches. A top plate 82 spans the distance 80, for example, between the upright side plates 76 and interconnects them near an upper margin of the center sill, as may be seen in FIG. 6. The top plate 82 has a thickness 84 that is greater than the thickness 78 of each side plate 76. For example, the thickness 84 may be 3⁄8 inch.

The bottom plate 56 is welded to the bottom margins of the side plates 76 and extends horizontally outward beyond the side plates 76 by a distance 86 of for example, 16 inches, on each side of the center sill 26, so that the center sill 26 in the intermediate portion 50 of the car body 12 thus has the form of a closed rectangular box with a laterally extending flange on each side of its bottom face. The bottom plate 56 preferably has a thickness 88 which is similar to the thickness 78 of each side plate 76. For example, the thickness 88 is preferably 5⁄16 inch. The distance 86 should be at least half the distance 80 and is preferably greater than the distance 80, so that the bottom plate 56 includes ample material to carry the forces developed in the bottom of the center beam 24, although the weight of the bottom plate 56 is spread laterally. The bottom plate 56 thus is available to act as a portion of the cargo supporting floor structure and to aid in providing stiffness of the center sill to resist lateral bending in the intermediate portion 50 of the car 10.

In order to support the cargo-carrying floor in the intermediate portion 50 of the car at the relatively low height of the bottom plate 56, lower than the height of the tops of the wheels of the trucks 14, several crossbearers 90 extend transversely beneath and are attached to the center sill 26. Each of the opposite ends 92 of each crossbearer 90 is welded to the respective side sill 58. Each crossbearer 90 includes an upstanding web member 94 and a horizontal bottom chord or flange of which a central portion 96 is of relatively thick steel plate, having a thickness 98 of, for example, ⅝ inch. Outboard portions 100 of the flange of the crossbearer 90 are preferably of thinner material such as steel plate 5⁄16 inch thick, which is amply strong for the loads imposed, while the greater thickness 98 of the central portion 96 of the flange is desirable to carry the compressive loads imposed by the weight of the lading carried on the car 10.

The web 94, like the outboard portions 100, is similarly of thinner material such as sheet or plate material ¼ inch thick, and the upper margin 104 of the web 94 is welded to the underside of the bottom plate 56.

A pair of stringers 102 extend longitudinally along the underside of the laterally extending, or outboard, portions of the bottom plate 56 of the center sill 26, providing stiffening support and helping to stabilize the interconnection of the webs 94 of the crossbearers 90 with the bottom plate 56.

Each floor sheet 54 overlaps the respective longitudinally extending side margin 106 of the bottom plate 56 by a small distance and is welded to it. The floor sheet 54 extends outboard and has its outboard margin welded to the side sill 58, whose upper flange forms the outboard-most portion of the cargo-carrying surface of the floor in the intermediate portion 50 of the car 10.

Figure 4:
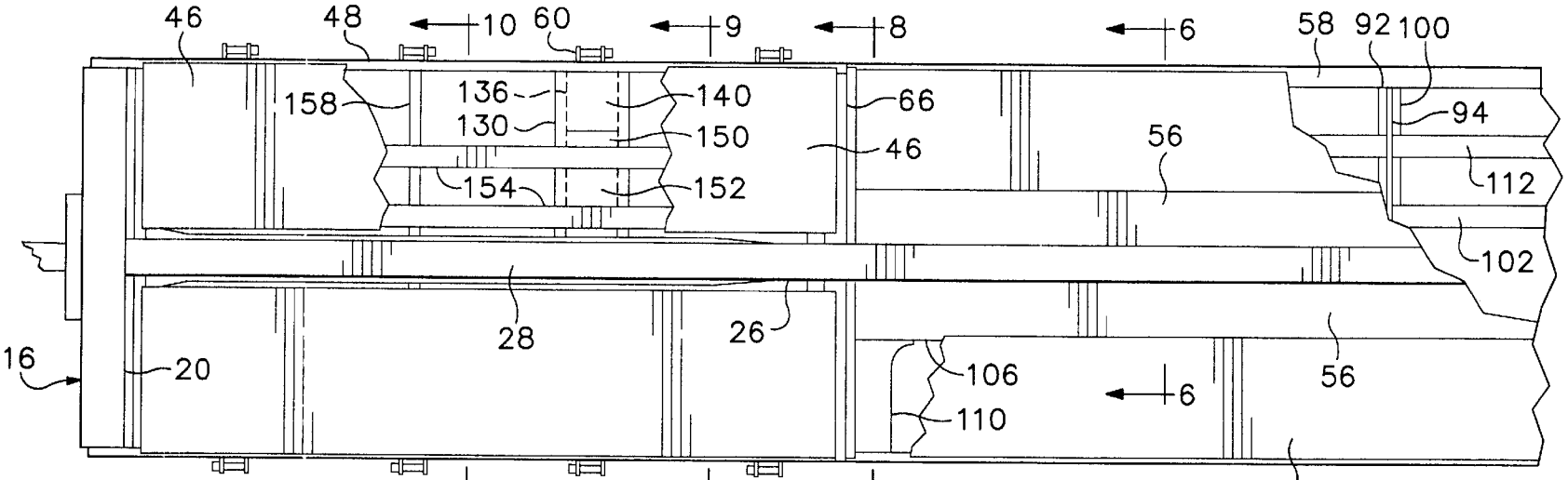
FIG. 4 is a top plan view of a portion of the center beam railroad car shown in FIG. 3.
Figure 5:
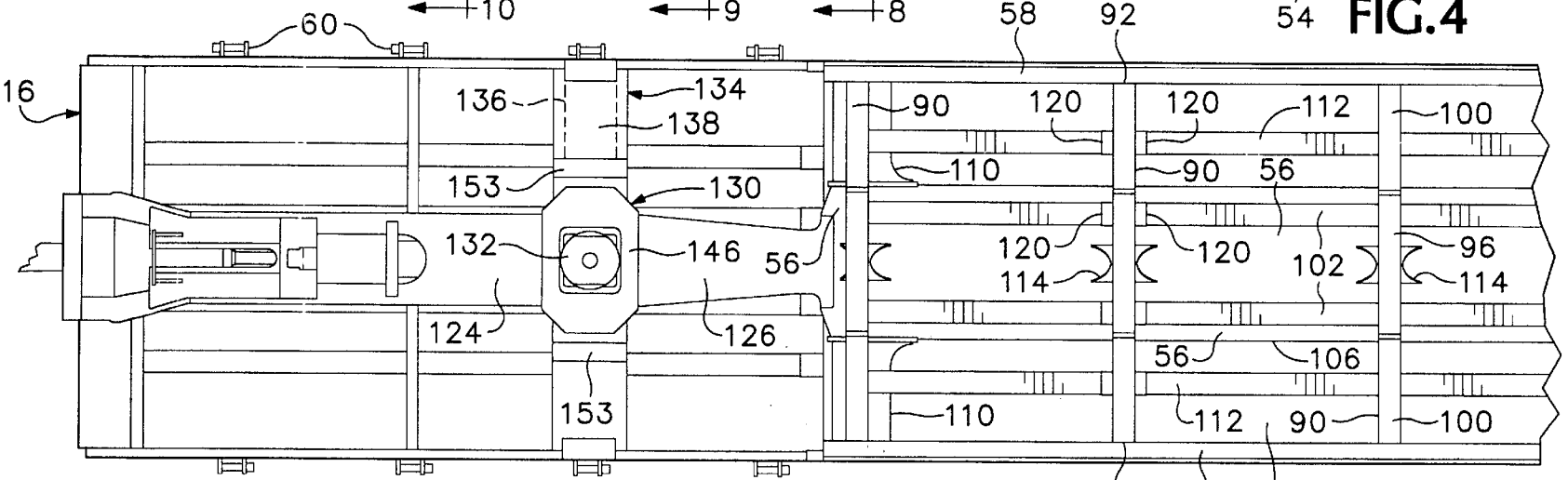
FIG. 5 is a bottom plan view of the portion of the center beam railroad car shown in FIG. 4.
Figure 8:
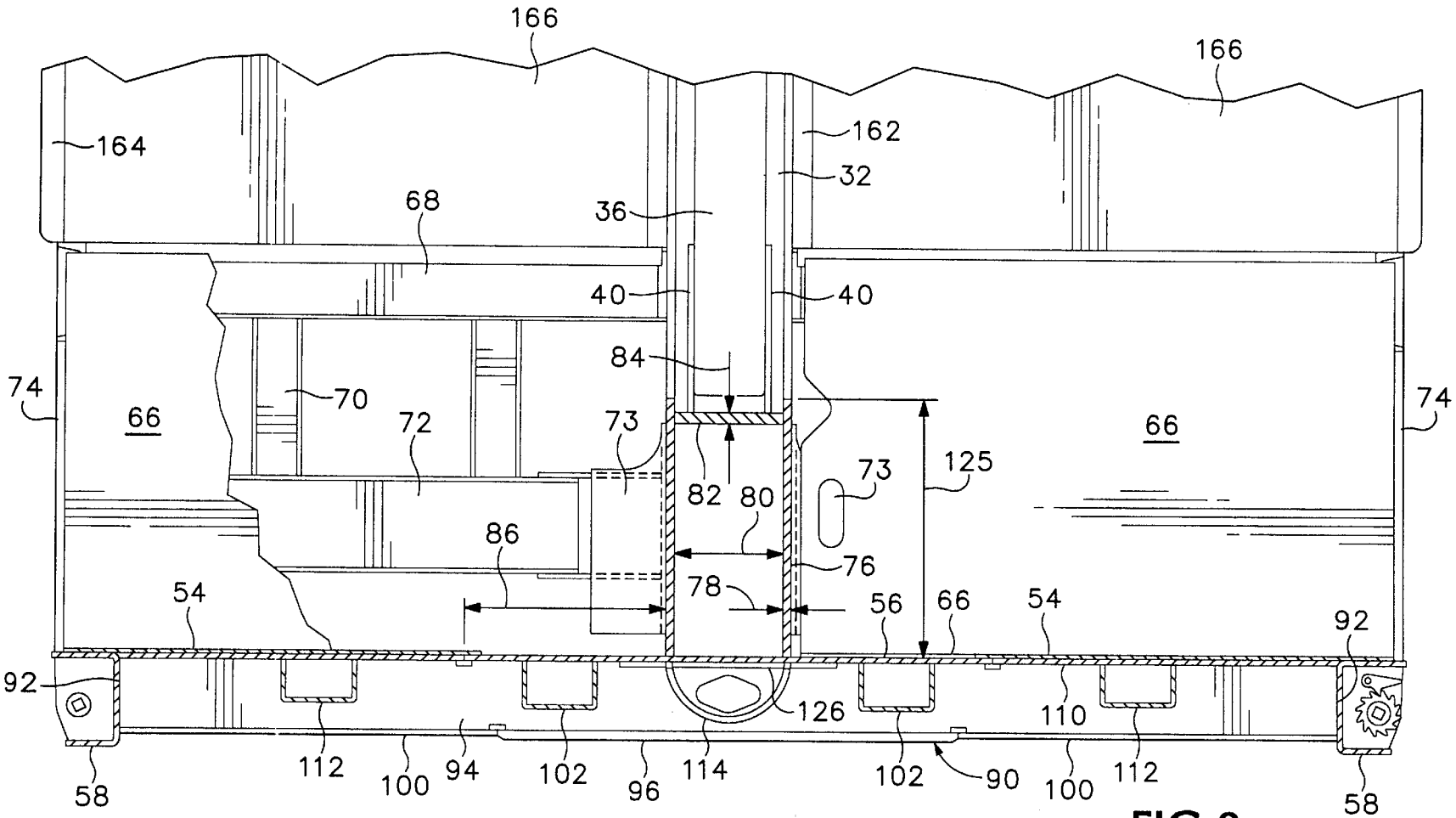
FIG. 8 is a partially cutaway sectional view of the center beam railroad car shown in FIG. 4, taken along line 8—8.

At each end of the intermediate portion 50 of the car body 12 an extension plate 110 extends laterally beneath the floor sheet 54, from the outward margin of the bottom plate 56 to the side sill 58, as may be seen in FIGS. 4, 5 and 8. The web 94 of the crossbearer 90 at each end of the intermediate portion 50 of the car is thus attached to the underside of each of the plates 110, as shown in FIG. 8.

Extending parallel with the stringers 102 are stringers 112 attached to the underside of the floor sheets 54 and to the webs 94 of the crossbearers 90. The floor sheets 54 are preferably of material significantly thinner than the material of the bottom plate 56 of the center sill. For example, the floor sheets 54 may be of 11 gauge sheet steel, i.e., 0.1196 inch in thickness, but they are supported by the bottom plate 56, the side sills 58, the webs 94 of the crossbearers 90, and the stringers 112, and thus provide ample strength to support the types of lading for which the car 10 is intended.

In addition to having their webs 94 welded to the underside of the bottom plate 56 of the center sill 26, the crossbearers 90 are connected with the center sill 26 through gussets 114 which are in the form of tapered, hollow semicylinders, or half-pipes. As shown best in FIG. 7, a pair of parallel upper margins 116 of each gusset 114 are welded to the underside of the bottom plate 56 of the center sill 26, aligned opposite the side plates 76 of the center sill. A semicircular end face 118 of each gusset 114 is welded to the web 94 of a crossbearer 90. Each gusset 114 is tapered to a shorter length further from the bottom plate 56, near the central portion 96 of the crossbearer 90, while the upper margins 116 are longer, to distribute loads from the crossbearer 90 over a significant length of the center sill 26. The gussets 114 may be formed of steel 5⁄16 inch thick, for example.

In order to facilitate installation of the stringers 102 and 112 during construction of the car, a short sleeve 120 fit around one end of each stringer 102 or 112, which is somewhat shorter than the space between crossbearer webs 94 where the stringer fits. The sleeves 120 are welded to the stringers, the underside of the floor plate 54 or bottom plate 56, and the adjacent web 94, while the remainder of each stringer 102 or 112 is welded in place tight against a web 94 at the opposite end of the stringer.

The resulting floor in the intermediate portion 50 is a significantly integrated structure incorporating the stringers 102 and 112 and the crossbearers 90, which, in turn, are securely attached to the underside of the center sill 26, through the web 94 and the gussets 114. The portions of the bottom plate 56 which extend laterally beyond the side plates 76 of the center sill are supported between the crossbearers 90 by the attached stringers 102 and provide part of the cargo-carrying floor surface. The center sill 26 is thus reinforced by the floor structure just described, which serves as part of a wide bottom chord of the center beam whose columns 30, 32 and 34 and diagonal members 36 extend upward to the top chord 28.

The intermediate portion 50 of the car 10 preferably has a length 122, established by the distance between the shear plates 66, that is related to a multiple of the usual length of packages of goods which the car 10 is intended to carry. For example, the distance 122 may be 40 feet 6 inches, allowing five bundles of lumber or sheet of plywood each 8 feet long and 4 feet wide to fit in the intermediate portion 50 of the car between the shear plates 66 and below the height of the end portion floors 44. The lading can thus be conveniently stacked on the depressed floor to a height equal to the height difference 62, above which the lading of the car can extend over a greater length established by the distance between the bulkheads 20 and 22, which is also preferably related to the usual cargo package size.

In the intermediate portion 50 of the car 10, the depth 125 of the center sill 26, established by the vertical height of the side plates 76, is greater than in the end portions 42 of the car 10. The center sill 26 is also narrower in the intermediate portion 50 than in the end portions 42. Because the floor 44 of each end portion 42 is located above the stub end portions 124 of the center sill 26, and because it is desirable for the car to rest as low as practical on the trucks 14, in order to minimize the height of the center of gravity of the car 10, the stub end portions 124 are wider but shallower, as may be seen clearly in FIGS. 3 and 5 and by comparison between FIGS. 8 and 9.

A sloping portion 126 of the bottom plate of each stub end portion 124 of the center sill 26 is welded to the bottom plate 56 beneath the reinforced shear plates 66, as shown best in FIG. 5. The sloping portion 126 and the horizontal portion 128 of the bottom plate of the stub end portions 124, shown also in FIG. 9, have a greater thickness than the bottom plate 56, and may be, for example, ¾ inch thick. A top plate 129 of the stub end portions 124 of the center sill 26 is of relatively thick plate, for example, ½ inch thick.

Figure 9:
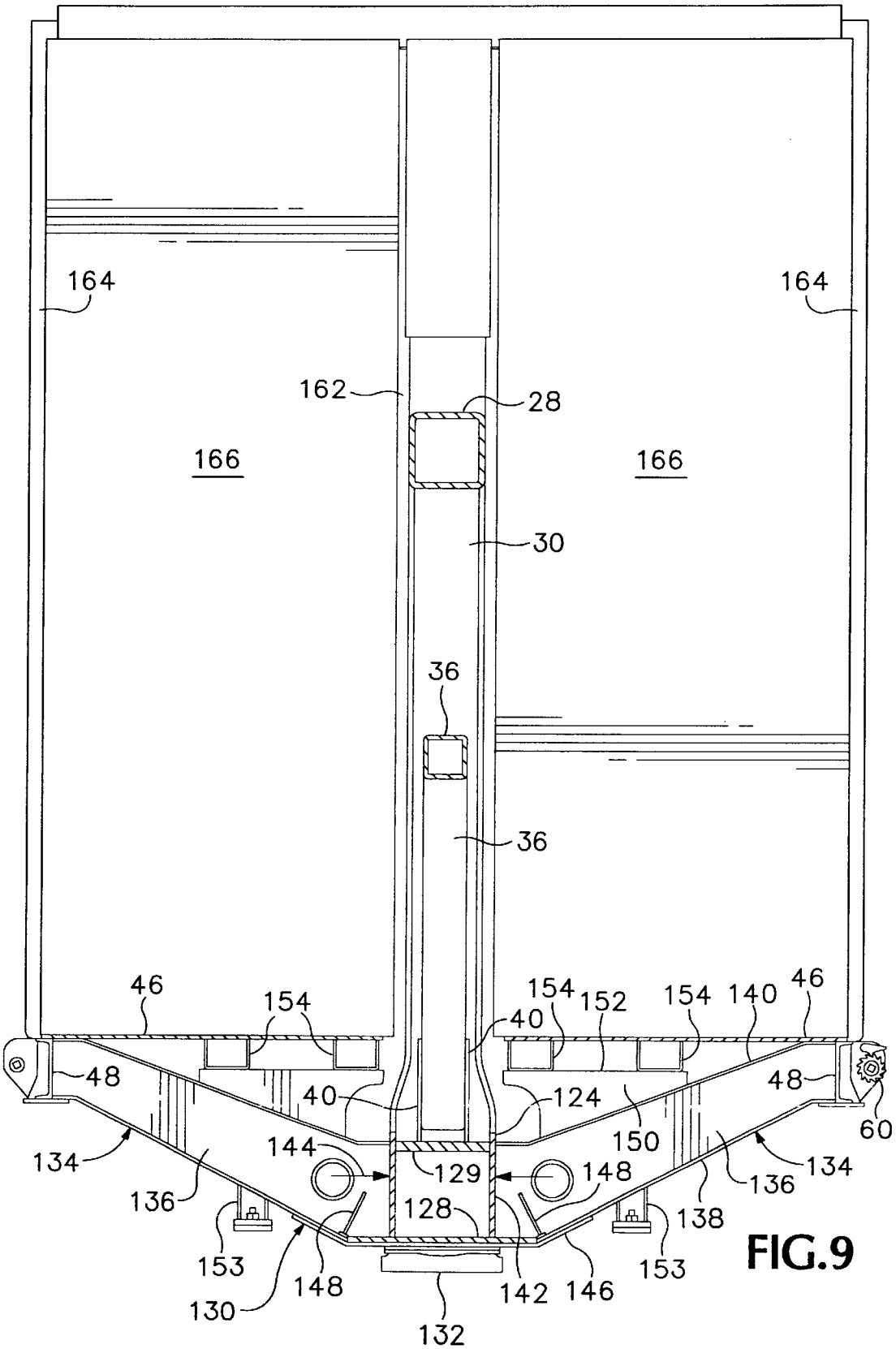
FIG. 9 is a sectional view of the center beam railroad car shown in FIG. 4, taken along line 9—9.

Interconnected with the stub end portions 124 of the center sill 26 in each of the end portions 42 is a respective body bolster 130 which rests atop the wheeled truck 14 that supports that end of the car body 12. As shown in FIG. 9, a center bearing 132 is associated with the bottom of the body bolster 130.

A pair of lateral arms 134 extend laterally outward and diagonally upward from the stub end portion 124 of the center sill to the upper or end portion side sills 48, and each is welded to the respective side sill 48. Each arm 134 includes a pair of upright transverse plates, or side plates 136, tapered and extending outwardly from the center sill, parallel with each other and spaced apart from each other in a direction parallel with the length of the car 10. The side plates 136 are interconnected with each other by a bottom plate 138 and a top plate 140 that extend longitudinally of the car body 12 beyond each side plate 136 so that each arm 134 has the form of a tapered flanged box beam. The bottom plate 128 of the stub end portion 124 of the center sill 26 extends laterally outward beyond each of its side plates 142 for a distance of about one-half the width 144 of the stub end portion 124, and so the bottom plate 138 of each arm 134 is welded to an adjacent portion of the lateral margin of the bottom plate 128 of the stub end portion 124.

A tie plate 146 which may be ½ inch thick extends along a portion of each bottom plate 138 and the bottom plate 128, providing an additional thickness of material to carry the loads encountered where the arms 134 are interconnected with the stub end portion 124, and gussets 148 provide additional reinforcement along the margins of the bottom plate 128.

Mounted atop each of the arms 134 of the body bolster 130 is a floor support riser 150 in the form of a downwardly open U-shaped channel that provides a flat horizontal top face 152 and has sides aligned with the side plates 136.

A side bearing foundation 153 is integrated with the lower side of each arm 134, and extends downward beneath the bottom plate 138, as may be seen in FIGS. 2, 5 and 9.

A pair of longitudinally extending floor support stringers 154, preferably in the form of channels similar to the stringers 102 and 112, are mounted atop the horizontal top face 152, and are welded to the underside of the end portion floor sheet 46 on each lateral side of the car body 12. The stringers 154 extend longitudinally from the reinforcement channel 68 supporting the shear plate 66 to the end sill 156 located beneath the bulkhead 20, in order to provide support for the floor sheets 46, which are preferably of 11 gauge sheet steel (0.1196 inch thick).

Figure 10:
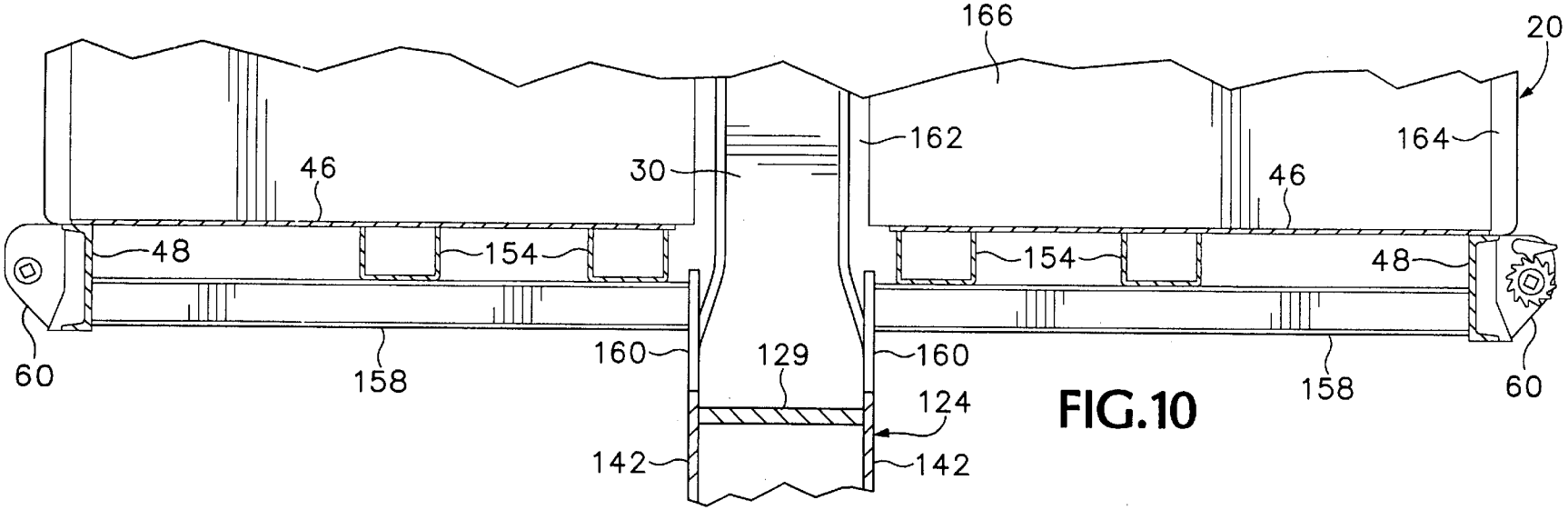
FIG. 10 is a sectional view of the center beam railroad car shown in FIG. 4, taken along line 10—10.
Figure 7:
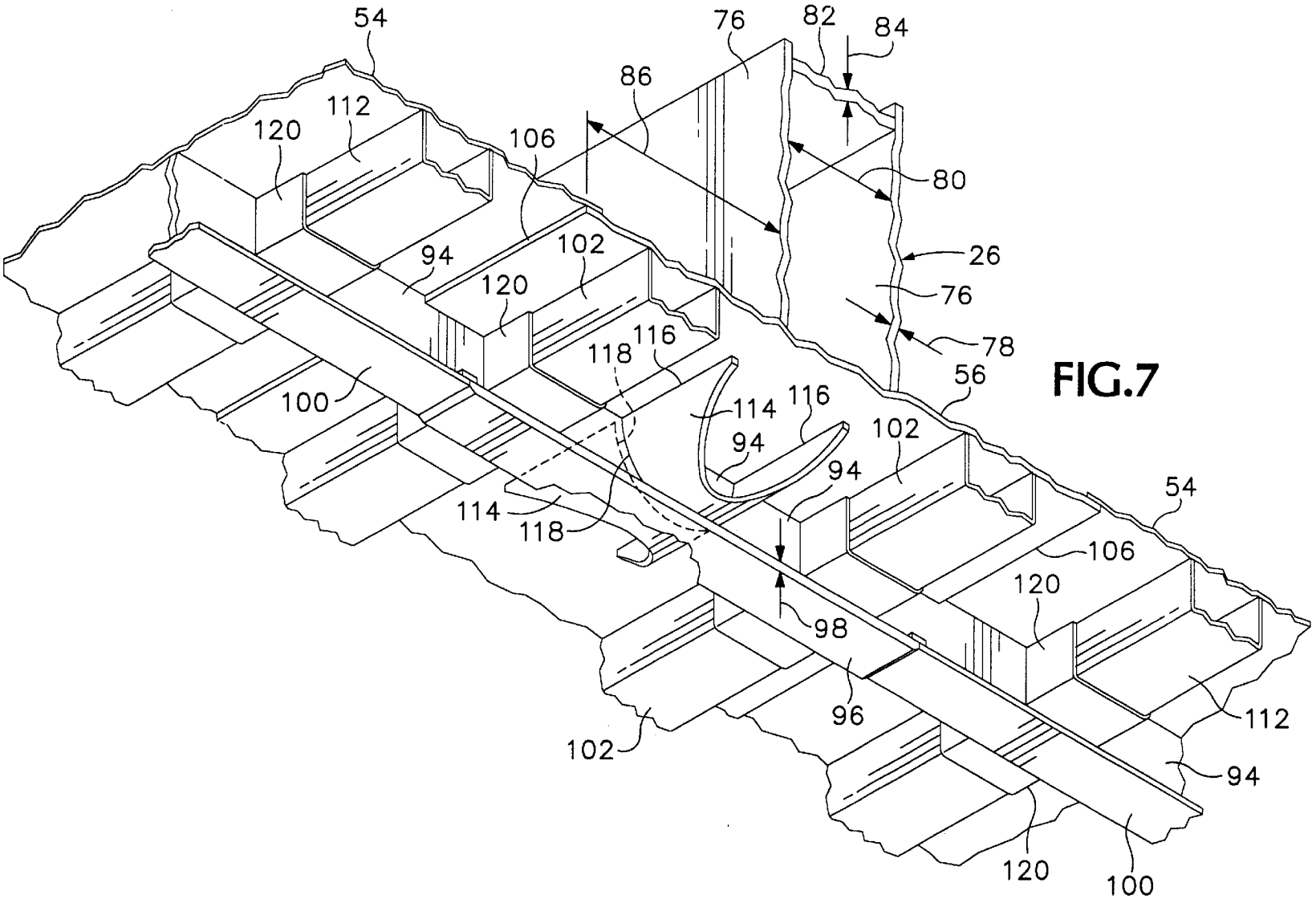
FIG. 7 is an isometric view of a portion of the center sill and floor structure of the center beam railroad car shown in FIGS. 1–6, taken from the underside of the intermediate portion thereof.

As shown in FIG. 10, the stringers 154 are also supported between the body bolster 130 and the end sill 156 by a transversely extending support member 158, preferably in the form of a channel of bent sheet steel thick and having horizontal flanges and a vertical web. The support members 158 each extend from a side sill 48 laterally inward to a support plate 160 welded to and extending upward from a respective side plate 142 of the stub end portion 124 of the center sill 26, as shown in FIG. 10.

Each stub end portion 124 houses appropriate gear to support a conventional coupler at each end 16 or 18 of the car body 12.

Each bulkhead 20 or 22 extends upwardly above the respective end sill 156, and preferably includes a closed section central column 162 fabricated of a pair of channels connected by flat plates, and a pair of side columns 164 in the form of outwardly facing channels, with a pair of face plates 166 on each bulkhead 20 or 22 facing toward the opposite end 16 or 18 of the car body. Each face plate 166 is reinforced by horizontal channels 168 welded to the outboard side of each bulkhead 20 and 22 between the central column 162 and each column 164, as shown in FIG. 2.

The railroad car 10 with the structure described above is amply strong yet lighter in tare weight than previously known railroad freight cars of depressed floor center beam construction, and thus is potentially cheaper to construct and to operate.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A freight-carrying railroad car, having a body having a pair of opposite sides, a length, a pair of opposite ends each supported on a wheeled truck, said body comprising:

(a) a center sill extending longitudinally along said body;

(b) a center beam extending along said center sill, the center beam including said center sill, a top chord parallel to and spaced upwardly above and apart from said center sill, and a plurality of upright members each attached to and extending between said center sill and said top chord;

(c) a plurality of crossbearers, each attached to and extending transversely beneath said center sill, and a floor supported atop said crossbearers on each of said opposite sides of said car body; and (d) wherein an intermediate portion of said center sill located between said opposite ends of said body includes a pair of upright side plates spaced laterally apart from each other and a horizontal bottom plate interconnecting said side plates with each other and extending laterally outward beyond both of said side plates, and said floor including a floor sheet extending outboard laterally beyond said bottom plate, whereby said bottom plate of said center sill acts as an inboard portion of said floor.

2. The railroad car of claim 1 wherein said floor sheet is in substantially co-planar alignment with said bottom plate and a margin of said floor sheet is welded to a margin of said bottom plate.

3. The railroad car of claim 1, said body including a pair of side sills located respectively on said opposite sides of said body, each of said crossbearers having a pair of outboard ends and each of said outboard ends being attached to a respective one of said side sills.

4. The railroad car of claim 1 wherein said center sill extends longitudinally of said body from one to the other of said opposite ends.

5. The railroad car of claim 1 wherein said crossbearers are of inverted "T" construction, each including a horizontal bottom flange member attached to a vertical web plate having an upper margin attached to an underside of said bottom plate of said center sill.

6. The railroad car of claim 5 wherein each of said crossbearers includes a pair of outboard portions and a central portion, said central portion being located beneath and spaced apart from said bottom plate of said center sill, said central portion being at least twice as thick as said outboard portion.

7. The railroad car of claim 1, further including a longitudinal stringer attached to an underside of said bottom plate of said center sill and extending longitudinally along said car body parallel with said center sill.

8. The railroad car of claim 1 wherein said center sill has a pair of end portions, each end portion being wider than said intermediate portion thereof and interconnected with said intermediate portion thereof by a transition portion, said bottom plate of said intermediate portion being located at a lower height than a respective bottom plate of either of said end portions.

9. The railroad car of claim 1 wherein said intermediate portion of said center sill includes a top plate interconnecting said upright side plates thereof and wherein said bottom plate of said intermediate portion of said center sill is thinner than said top plate.

10. The railroad car of claim 1 wherein said side plates are separated laterally from each other by a first distance and wherein said bottom plate of said intermediate portion of said center sills extends laterally outward beyond said each of side plates of said center sill a second distance at least half as great as said first distance.

11. The railroad car of claim 10 wherein said second distance is at least as great as said first distance.

12. In a freight-carrying railroad car of center beam construction and including an elongate car body having opposite sides and a pair of opposite ends defining a length, an integrated center sill and floor structure in a portion of said car body, said integrated center sill and floor structure comprising:

(a) a pair of upright longitudinally extending center sill side plates spaced a first distance laterally apart from each other, each said center sill side plate having a top margin and a bottom margin;

(b) a center sill top plate interconnecting the top margins of said center sill side plates with each other;

(c) a center sill bottom plate extending along and attached to said bottom margins of both of said center sill side plates and extending laterally outboard a second distance beyond each of said pair of side plates;

(d) a plurality of crossbearers interconnected with said center sill beneath said bottom plate and extending laterally beyond said bottom plate on each of said opposite sides of said car body;

(e) a floor sheet, mounted atop said crossbearers and attached to and extending laterally outward from said bottom plate; and (f) a stringer attached to an underside of said bottom plate at a location outboard from said pair of side plates, said stringer extending longitudinally from one of said crossbearers to another one thereof.

13. The integrated center sill and floor structure of claim 12, further including a stringer attached to an underside of said floor sheet and extending longitudinally from one of said crossbearers to another one thereof.

14. The integrated center sill and floor structure of claim 13, including a semicylindrical gusset interconnecting said bottom plate of said center sill with said web of said crossbearer.

15. A railroad freight car including said integrated center sill and floor structure of claim 12 in an intermediate portion of said car located between a pair of opposite end portions thereof.

16. The integrated center sill and floor structure of claim 12 wherein said crossbearers are of inverted "T" construction including an upstanding web and a horizontal flange, and wherein the crossbearers have opposite ends each attached to a side sill of the car.

17. The integrated center sill and floor structure of claim 15 wherein a central portion of said flange of said crossbearer located beneath said bottom plate of said center sill is at least about twice as thick as a portion of said flange located laterally outboard of said bottom plate of said center sill.

18. A freight-carrying railroad car, comprising:

(a) a body having a pair of opposite sides, a length, and a pair of opposite ends;

(b) a center sill extending longitudinally from one end to the opposite end of the body;

(c) a pair of side sills spaced apart from said center sill, each extending along a respective one of said pair of opposite sides of said car body;

(d) a body bolster interconnected with said center sill at one of said opposite ends of said body and supported on a wheeled truck, said body bolster including a pair of arms each extending laterally outward and diagonally upward from said center sill toward a respective one of said opposite sides of said body and supporting a respective one of said side sills;

(e) a floor support riser attached to an upper face of one of said arms of said body bolster, said floor support riser having a horizontal top face; and (f) a floor sheet supported by said side sills and extending above said floor support riser.

19. The railroad car of claim 18, including a longitudinal floor support stringer carried on said top face of said floor support riser, said floor sheet being attached to said side sill and said longitudinal support stringer.

20. The railroad car of claim 18 wherein said center sill includes a pair of upright longitudinally extending side plates spaced laterally apart from each other, a horizontal top plate interconnecting said side plates, and a horizontal bottom plate interconnecting said side plates and extending laterally outward beyond each said side plate, and wherein each of said arms of said body bolster includes a respective bottom plate welded to a respective margin of said horizontal bottom plate of said center sill, said body bolster further including a tie plate extending laterally beneath said bottom plate of said center sill and overlapping a portion of said bottom plate of each of said arms of said body bolster.

21. The railroad car of claim 18 wherein each of said arms of said body bolster is of box beam construction including a top plate, a bottom plate, and a pair of parallel tapered upright transverse plates spaced apart from each other in a longitudinal direction with respect to said body.

22. The railroad car of claim 18, including a side bearing mounted on a lower side of each of said arms.

* * * * *